US006791525B2

(12) United States Patent
Matsumura et al.

(10) Patent No.: US 6,791,525 B2
(45) Date of Patent: Sep. 14, 2004

(54) DISPLAY APPARATUS AND DRIVING METHOD THEREFOR

(75) Inventors: Tatsuya Matsumura, Kikuchi-gun (JP); Susumu Shibata, Kikuchi-gun (JP)

(73) Assignee: Advanced Display Inc., Kikuchi-gun (JP)

( * ) Notice: Subject to any disclaimer, the term of this patent is extended or adjusted under 35 U.S.C. 154(b) by 66 days.

(21) Appl. No.: 09/956,014

(22) Filed: Sep. 20, 2001

(65) Prior Publication Data

US 2002/0033813 A1 Mar. 21, 2002

(30) Foreign Application Priority Data

Sep. 21, 2000 (JP) ..... 2000-287288

(51) Int. Cl.[7] ..... G09G 3/36

(52) U.S. Cl. ..... 345/100; 345/87; 345/94; 345/204

(58) Field of Search ..... 345/87–104, 208–210, 345/58, 204

(56) References Cited

U.S. PATENT DOCUMENTS 5,920,300 A * 7/1999 Yamazaki et al. ..... 345/94
6,219,017 B1 * 4/2001 Shimada et al. ..... 345/88
6,501,451 B1 * 12/2002 Sakashita ..... 345/87
6,556,180 B1 * 4/2003 Furuhashi et al. ..... 345/87

FOREIGN PATENT DOCUMENTS

| | | |
|---|---|---|
| JP | 64-10299 | 1/1989 |
| JP | 3-96993 | 4/1991 |
| JP | 3-174186 | 7/1991 |
| JP | 4-288589 | 10/1992 |
| JP | 11-126052 | 5/1999 |
| JP | 11-271710 | 10/1999 |

* cited by examiner

*Primary Examiner*—Lun-Yi Lao
(74) *Attorney, Agent, or Firm*—Oblon, Spivak, McClelland, Maier & Neustadt, P.C.

(57) ABSTRACT

The present invention is directed to a display apparatus including a correcting means for producing a current corrected data signal by using a current image data signal and a previous corrected data signal; a storage means for storing said current corrected data signal within a predetermined frame period, outputting said current corrected data signal as the previous corrected data signal in such a manner as to be delayed at most said predetermined frame period; and a display means driven by a driving signal corresponding to said current corrected data signal.

12 Claims, 10 Drawing Sheets

IMAGE DATA SIGNAL
7

LIQUID CRYSTAL DRIVING VOLTAGE
8
LIQUID CRYSTAL DRIVING VOLTAGE
A
LIQUID CRYSTAL DRIVING VOLTAGE
10

TRANSMITTANCE
B
9
t
PRESENT FRAME
NEXT FRAME

IMAGE DATA SIGNAL
8

LIQUID CRYSTAL DRIVING VOLTAGE
34
LIQUID CRYSTAL DRIVING VOLTAGE
10

35
TRANSMITTANCE
t
PRESENT FRAME
NEXT FRAME

DISPLAY APPARATUS AND DRIVING METHOD THEREFOR

BACKGROUND OF THE INVENTION

The present invention relates to a display apparatus and driving method for the same. More particularly, the present invention is suitably applied to a liquid crystal display apparatus.

FIG. 6 is an explanatory view showing a construction of a conventional liquid crystal display apparatus. In FIG. 6, reference numeral 20 indicates a liquid crystal panel serving as a display means, 21 denotes a scanning line driving circuit for driving scanning lines, 22 denotes a signal line driving circuit for driving signal lines, 23 denotes a control circuit for controlling input signals inputted to the scanning line control circuit, the signal line control circuit and the like, and 24 denotes a power supply section for generating the reference voltages of the driving circuits 21 and 22.

With the electrical circuit configuration of the display apparatus such as a liquid crystal display apparatus, external input signals (the input signal of the control circuit 23) involve a clock input signal, an image data signal, a data enable input signal and the other control input signals (e.g., a horizontal synchronizing input signal and a vertical synchronizing input signal). Here, the data enable input signal defines the effective data period of the image data signal with respect to a time axis. Normally, the data enable input signal has a High voltage level in the effective data period and has a Low voltage level in periods other than the effective data period.

FIG. 7 is the graph showing a voltage of signals inputted into the control circuit 23 per horizontal cycle. In FIG. 7, horizontal axis direction represents a time axis, reference numeral 51 denotes a horizontal synchronizing input signal voltage, 52 denotes a data enable input signal voltage, 53 denotes a clock input signal voltage, 54 denotes an image data signal voltage, 1CLK denotes the cycle of a clock input signal and 1H denotes the cycle of the horizontal synchronizing signal. Also, an arrow at each edge of the clock input signal 53 denotes the active edge of the clock input signal (in case of FIG. 7, a falling edge is used as the active edge), D denotes the effective data period of the image data signal, the blank portion (that is, portion without hatching) of the image data signal voltage 54 corresponds to the effective data period and portions other than the blank portion (that is, hatched portion) of the image data signal voltage 54 corresponds to the ineffective data periods of the image data signal. Numerals 1, 2, 3, . . . , m corresponds to frame size (in other word, resolution or pixels) in horizontal direction. It is assumed herein that the Low voltage level of the horizontal synchronizing input signal indicates a reset period, meaning that no effective data period exists.

FIG. 8 is a voltage waveform view of signals inputted into the control circuit 23 per vertical cycle. In FIG. 8, horizontal axis direction represents a time axis, reference numeral 55 denotes a vertical synchronizing input signal voltage, reference numeral 52 denotes a data enable input signal voltage, reference numeral 54 denotes an image data signal voltage, 1H denotes the cycle of the horizontal synchronizing input signal, 1V denotes the cycle of the vertical synchronizing input signal and D denotes the effective data period of the image data signal. Also, the blank portion (un-hatched portion) of the image data signal voltage 54 denotes the effective data period of the image data signal and portions other than the blank portions (hatched portion) denote ineffective data periods. Numerals 1, 2, 3, . . . , n denote frame size (resolutions or pixels) in vertical direction. It is assumed herein that the Low voltage level of the vertical synchronizing input signal indicates a reset period, meaning that no effective data period exists.

Further, as the output signals of the control circuit 23, clock signals and data signals are generated to be used as input signals inputted into the driving circuit 21 and 22 generating signals driving the liquid crystal panel 20. It is assumed herein that the clock signals represent clock signals used in the respective driving circuits 21 and 22 (i.e., a vertical clock signal for the scanning line driving circuit 21 and a horizontal clock signal for the signal line driving circuit 22). In addition, it is assumed that the data signals represent an image data signal (or horizontal image data output signal), control signals other than the image data signal (e.g., a horizontal start output signal, a vertical start output signal, a horizontal latch output signal and a horizontal driving voltage polarity control output signal) or the like.

In connection with a method of driving the ordinary liquid crystal display apparatus as stated above, a liquid crystal display apparatus disclosed in Japanese Patent No. 2,616,652 is shown in FIG. 9 as a conventional technique making it possible to realize the high-speed response of a liquid crystal. In FIG. 9, reference numeral 25 denotes a television antenna, reference numeral 26 denotes a tuner, reference numeral 27 denotes a television linear circuit, reference numeral 28 denotes a synchronous control circuit, reference numeral 29 denotes an A/D conversion circuit, reference numeral 30 denotes a common electrode driving circuit, 31 denotes an image memory capable of storing one-frame image data, reference numeral 32 denotes a comparison circuit and reference numeral 33 denotes a segment electrode driving circuit.

In the liquid crystal display apparatus constituted as shown in FIG. 9, the comparison circuit 32 compares the level of image data outputted from the A/D conversion circuit 29 and the level of image data read from the image memory 31 one frame later than the image data outputted from the A/D conversion circuit 29. If the present image data is higher in level than the one-frame-prior image data, the comparison circuit 32 outputs a maximum value "7", i.e., "111" as image data D1 to D3 and outputs "1" as a gradation change signal. Further, if the one-frame-prior image data is equal in level to the present image data, the comparison circuit 32 outputs the image data fed from the A/D conversion circuit 29 as image data D1 to D3 as they are and outputs "0" as a gradation change signal. Further, if the present image data is lower in level than the one-frame-prior image data, the comparison circuit 33 outputs a minimum value "0", i.e., "000" as image data D1 to D3 and outputs "1" as a gradation change signal.

As a result of the comparison, if the present image data is higher in level than the one-frame-prior image data, the segment electrode driving signal is controlled to have high amplitude, i.e., to have high voltage, whereby the light transmittance of the liquid crystal panel 20 rises faster than that in case of the conventional driving method. Further, if the one-frame-prior image data is equal in level to the present image data, ordinary liquid crystal driving voltage is applied to the liquid crystal panel. If the present image data is lower in level than the one-frame-prior image data, the liquid crystal driving voltage is set lower than the ordinary voltage value, whereby the light transmittance of the liquid crystal panel 20 is lowered faster than that in case of the conventional driving method.

FIG. 10 shows the relationship among image data signal (a), liquid crystal driving voltage (b) and transmittance (c) in the liquid crystal display apparatus constituted as shown in FIG. 9, while the horizontal axis is a time axis. In FIG. 10, reference numeral 8 denotes a liquid crystal driving voltage shown in the above-cited reference (Japanese Patent No. 2,616,652), 34 denotes ordinary liquid crystal driving voltage of former technique, 10 denotes transmittance attained with the driving voltage 8 and 35 denotes ordinary transmittance attained with the driving voltage 34. In FIG. 10, if the ordinary liquid crystal driving voltage 34 simply corresponding to the image data signal (a) is applied, the transmittance of the liquid crystal panel gently rises as indicated by a broken line 35 of FIG. 10(*c*) due to a delay in the response speed of the liquid crystal itself, making it difficult for the liquid crystal to respond to the signal within one frame. As a result, if moving images or the like are displayed, an afterimage occurs. Considering this, according to the above-mentioned reference (Japanese Patent No. 2,616,652), if a current image data signal is higher in level than a one-frame-prior image signal as shown in FIG. 10(*a*), liquid crystal driving voltage 8 higher than the ordinary liquid crystal driving voltage 34 is applied in the present frame, thereby accelerate the response speed of the liquid crystal and the transmittance of the liquid crystal rises faster as indicated by reference numeral 10 of FIG. 10(*c*), thereby suppressing the occurrence of an afterimage which has conventionally occurred when the conventional liquid crystal display apparatus displays moving images.

According to the above-stated reference (Japanese Patent No. 2,616,652), the transmittance of the liquid crystal for the present frame rises faster as indicated by the transmittance 10 shown in FIG. 10(*c*). However, since the image data signal for the next frame is equal in level to those for the present frame as shown in FIG. 10(*a*), the ordinary liquid crystal driving voltage is applied even in the above-stated reference (Japanese Patent No. 2,616,652) for the next frame (i.e. the voltage 34 and the voltage 8 are equal for the next frame as shown in FIG. 10(*b*)). Therefore, the transmittance of the liquid crystal does not desirably converge on desired transmittance, with the result that deterioration of displayed image disadvantageously occurs or an afterimage disadvantageously occurs when displaying moving images.

The present invention has been made in view of the above-stated disadvantages. It is, therefore, an object of the present invention to provide a liquid crystal display apparatus capable of suppressing the occurrence of an afterimage when moving images are displayed by the liquid crystal display apparatus, suppressing the occurrence of a deterioration of displayed image or an after image caused thereby, and capable of displaying good moving images.

SUMMARY OF THE INVENTION

A first aspect of the present invention is a display apparatus comprising:

a correcting means for producing a current corrected data signal by using a current image data signal and a previous corrected data signal;

a storage means for storing said current corrected data signal within a predetermined frame period, outputting said current corrected data signal as the previous corrected data signal in such a manner as to be delayed at most said predetermined frame period; and a display means driven by a driving signal corresponding to said current corrected data signal.

Preferably, the said correcting means includes such a means for producing a current image data signal as the current corrected data signal when the current image data signal is equal to the previous corrected data signal, producing a value greater than said current image data signal as the current corrected data signal when said current image data signal is greater than the previous corrected data signal, and producing a value smaller than said current image data signal as the current corrected data signal when said current image data signal is smaller than the previous corrected data signal.

Preferably, the predetermined frame period is 1 frame period.

Preferably, the correcting means includes a means for producing such a current corrected data signal as to compensate a delayed time for responding which is peculiar to the display apparatus, and wherein said means is any one of an arithmetic unit and a table.

Preferably, the correcting means comprising:

a subtracting means for calculating a first value changing from the previous corrected data signal to the current image data signal;

an arithmetic unit means for producing such a changed value as a second value from said first value as to compensate a delayed time for responding which is peculiar to the display apparatus; and an adding/subtracting means for calculating the current corrected data signal by adding and/or subtracting the current image data signal and the second value.

A second aspect of the present invention is a method for driving a display apparatus, said method comprising steps of:

(i) producing a current corrected data signal from a current image data signal and a previous corrected data signal;

(ii) retaining said current corrected data signal for a predetermined frame period, and outputting said current corrected data signal serving as a previous corrected data signal after a prescribed delayed time at most said predetermined frame period; and (iii) driving a displaying means by a driving signal corresponding to said current corrected data signal.

Preferably, in the step (i), said current image data signal is produced as the current corrected data signal in a case where said current image data signal is equal to said previous corrected data signal, a value greater than said current image data signal is produced as the current corrected data signal in a case where said current image data signal is greater than said previous corrected data signal, and a value smaller than said current image data signal is produced as the current corrected data signal in a case where said current image data signal is smaller than said previous corrected data signal.

Preferably, the predetermined frame period is a single frame period.

Preferably, the step (i) includes a step of generating a current corrected data signal where a delay of a response peculiar to a liquid crystal display is compensated.

Preferably, the method further includes steps of:

calculating a first value changing from the previous corrected data signal to the current image data signal;

generating a second value from said first value, said second value serving as a changing value of the current corrected data signal from the current image date signal for compensating a delay of a response peculiar to a liquid crystal display; and calculating a current corrected data signal by adding said second value to said current image data signal or subtracting said second value from said current image data signal.

DETAILED DESCRIPTION

EMBODIMENT 1

Figure 1:
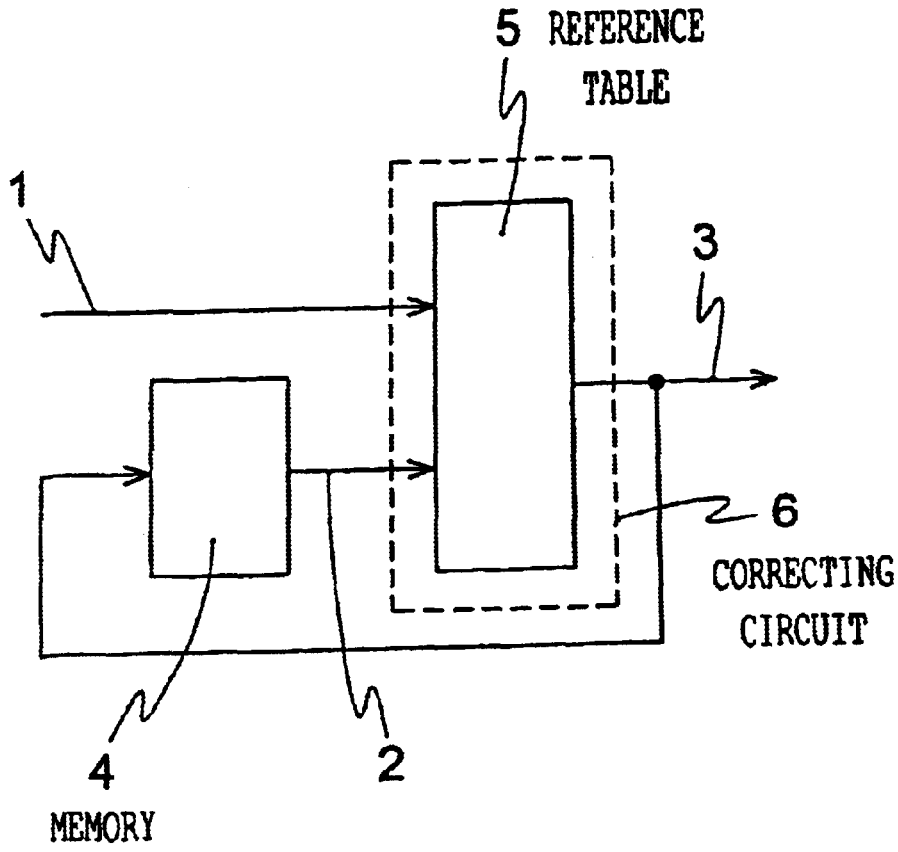
FIG. 1 is an explanatory view showing a correction circuit in a liquid crystal display apparatus of EMBODIMENT 1 of the present invention.

EMBODIMENT 1 of the present invention will be described hereinafter with reference to FIGS. 1 and 2. FIG. 1 shows a correction circuit for EMBODIMENT 1 of the present invention. The correction circuit is normally formed in a control circuit 23 shown in FIG. 6. In FIG. 1, reference numeral 1 denotes a current image data signal which is "raw" signal provided externally and not corrected yet. To be specific, the current image data signal means an image data signal inputted into the control circuit 23 shown in FIG. 6. Reference numeral 2 denotes a corrected image data signal displayed on a liquid crystal panel prior to predetermined frames (prior to one frame in this embodiment) and hereinafter referred as 'previous corrected data signal'. Reference numeral 3 denotes a current image data signal which has been corrected and obtained by the present invention to be, displayed on the liquid crystal panel and hereinafter referred as current corrected data signal. Reference numeral 4 denotes storage means consisting of, for example, a memory necessary to hold previous corrected data signals of predetermined frames (as described above, one frame in this embodiment), 5 denotes a reference table consisting of, for example, a memory necessary to store a data table and 6 denotes correcting means necessary to generate the current corrected data signal.

Figures 2A, 2B, 2C:
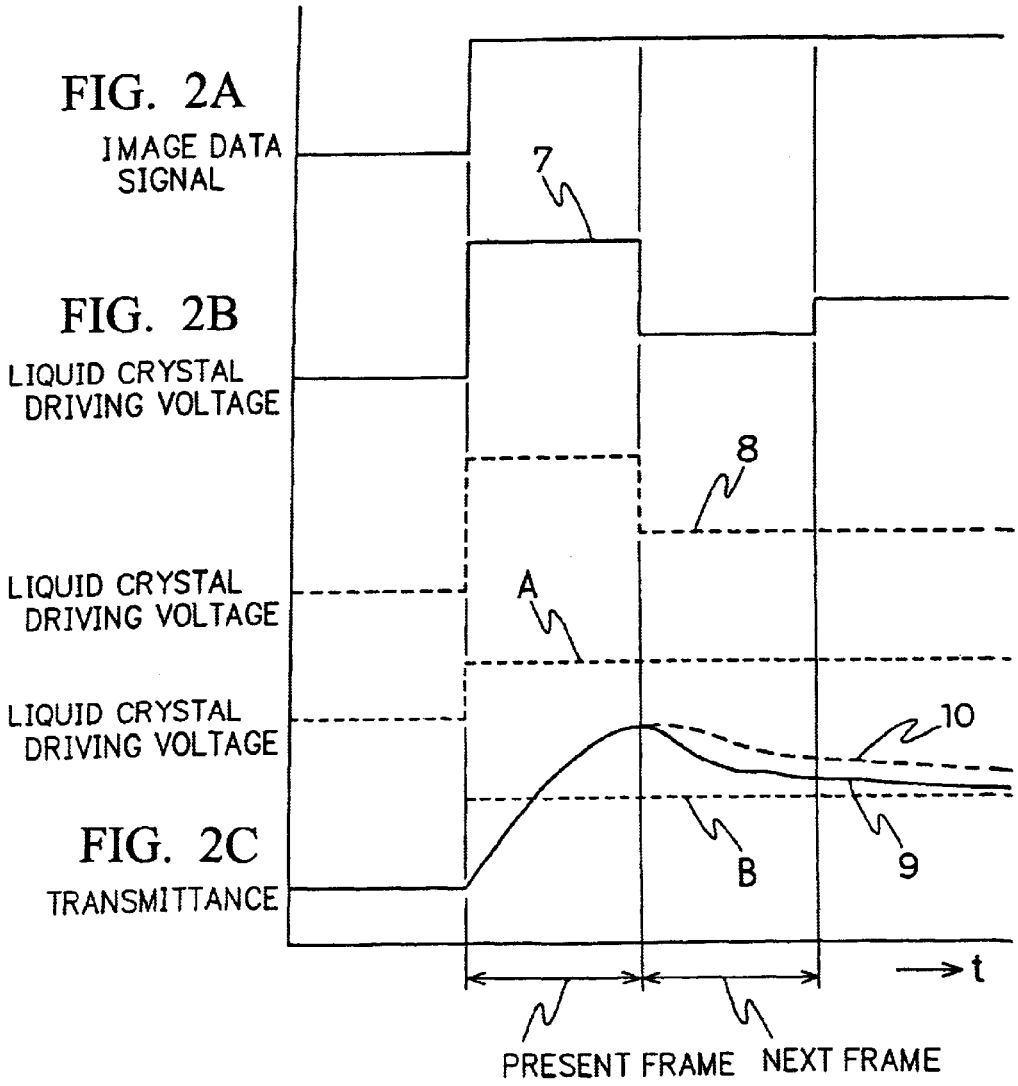
FIG. 2 is graphs showing relations of image data signal against time, liquid crystal driving voltage against time, and transmittance against time.

FIG. 2 shows the relationship among image data signal (a), liquid crystal driving voltage (b) and transmittance (c) while the horizontal axis is a time axis. In FIG. 2, reference numeral 7 denotes liquid crystal driving voltage according to the present invention, 8 denotes liquid crystal driving voltage according to the conventional technique disclosed in the Japanese Patent No. 2,616,652, "A" denotes ordinary liquid crystal driving voltage level according to the former technique corresponding to the image data signal (a), "B" denotes desired transmittance level, 9 denotes transmittance according to the present invention and 10 denotes transmittance according to the conventional technique.

First, a current corrected data signal 3 shown in FIG. 1 is fed back to and inputted into the storage means 4. The storage means 4 stores the current corrected data signal 3 for one frame and outputs the same to the correcting means 6 as a previous corrected data signal 2. By applying the reference table 5 to the current image data signal 1 with the previous corrected data signal 2 provided from the storage means 4, the correcting means 6 generates image data signal compensating for a response delay peculiar to the display apparatus and outputs the generated image data signal as the current corrected data signal 3. For example, it is effective to constitute the reference table 5 to generate the current image data signal 1 as the current corrected data signal 3 if the current image data signal 1 is equal to the previous corrected data signal 2, to generate signal higher in value than the current image data signal 1 as the current corrected data signal 3 if the current image data signal 1 is higher than the previous corrected data signal 2, and to generate signal lower in value than the current image data signal 1 as the current corrected data signal 3 if the current image data signal 1 is lower than the previous corrected data signal 2.

Here, the image data signal compensating for a response delay peculiar to the display apparatus are appropriately determined by conducting a processing such as multiplying the ordinary driving voltage by a coefficient, in view of the characteristics of the liquid crystal used herein, driving load derived from the layout of scanning lines and signal lines, and the like.

Figure 6:
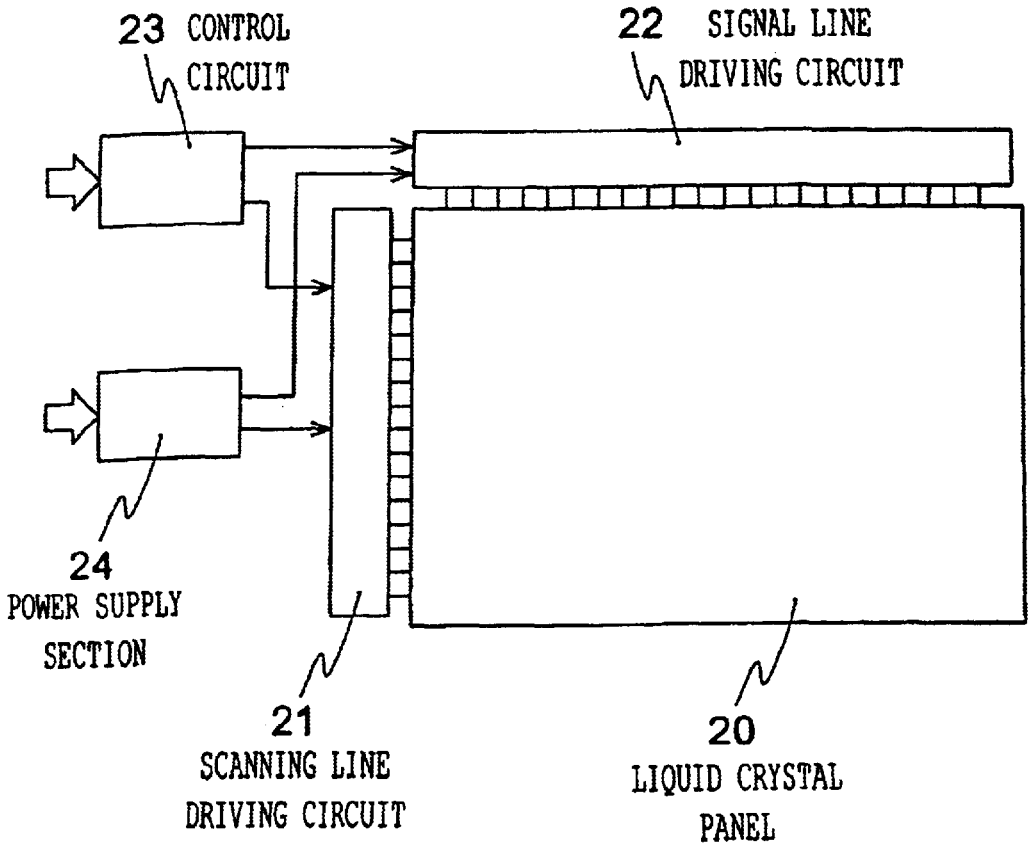
FIG. 6 PRIOR ART
FIG. 6 is an explanatory view showing the essential components constituting the liquid crystal display apparatus.
Figure 7:
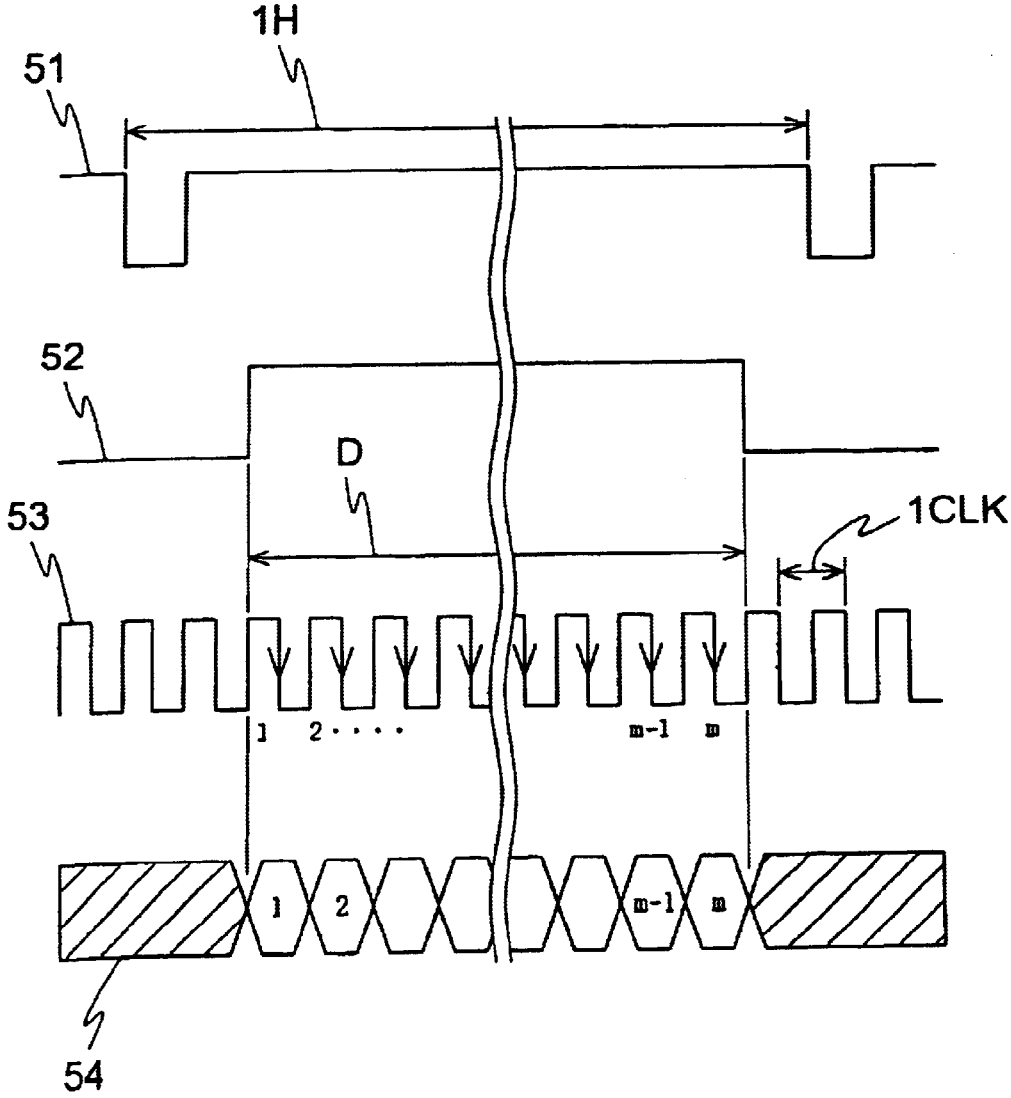
FIG. 7 PRIOR ART
FIG. 7 is graphs for showing a voltage of input signal per each horizontal period in a control circuit of the conventional liquid crystal display apparatus.
Figure 8:
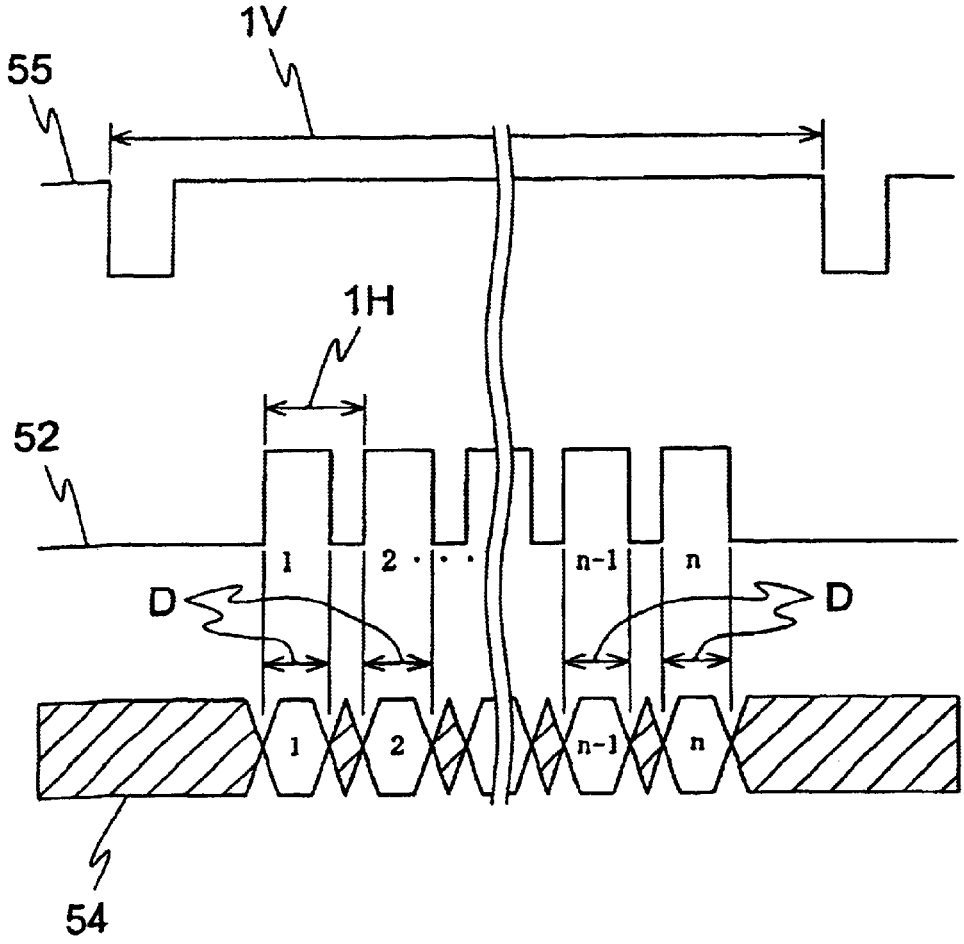
FIG. 8 PRIOR ART
FIG. 8 is graphs for showing a voltage of input signal per each vertical period in a control circuit of the conventional liquid crystal display apparatus.
Figure 9:
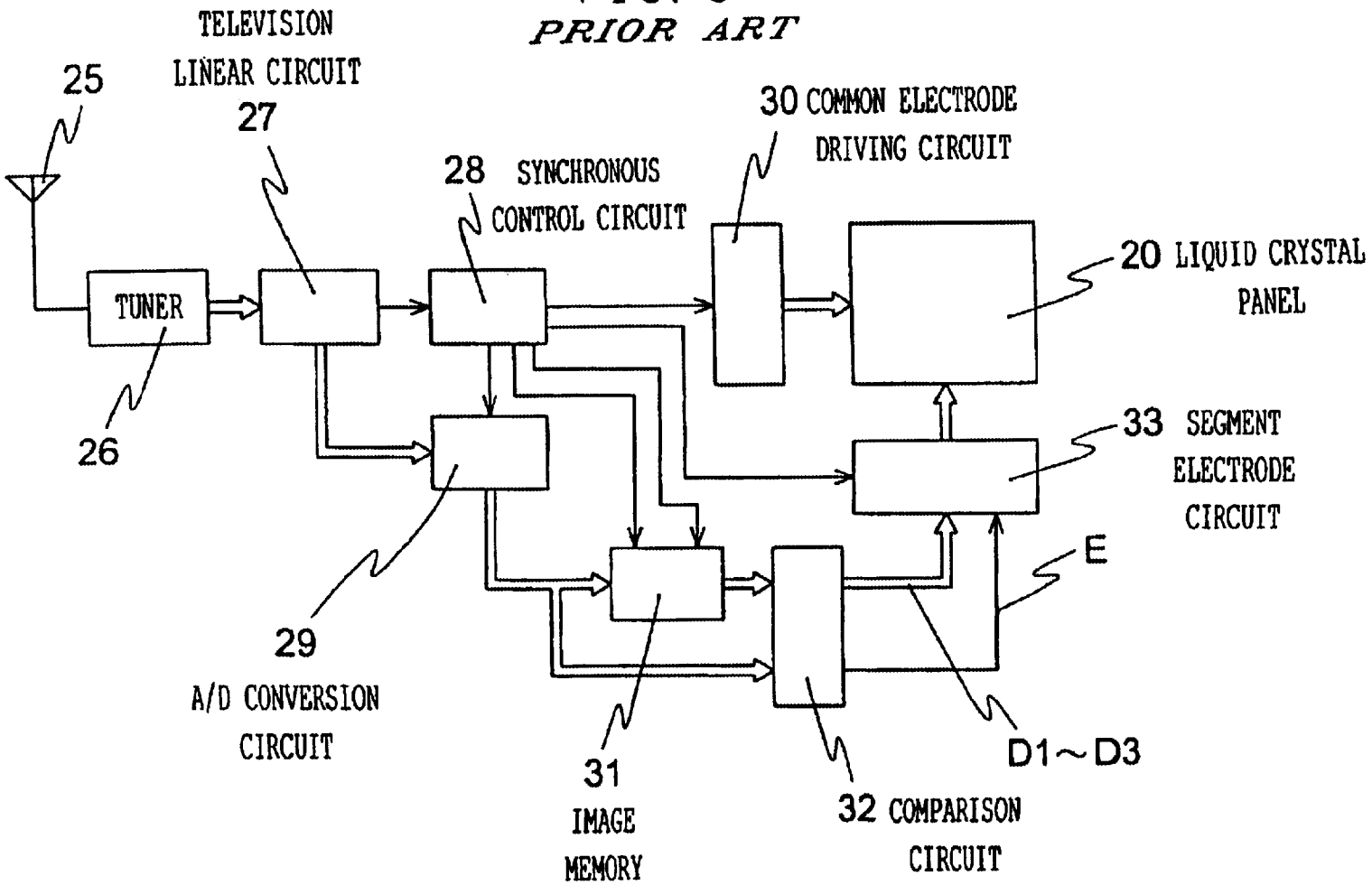
FIG. 9 PRIOR ART
FIG. 9 is an explanatory view showing a high-speed response technique in the conventional liquid crystal display apparatus.
Figures 10A, 10B, 10C:
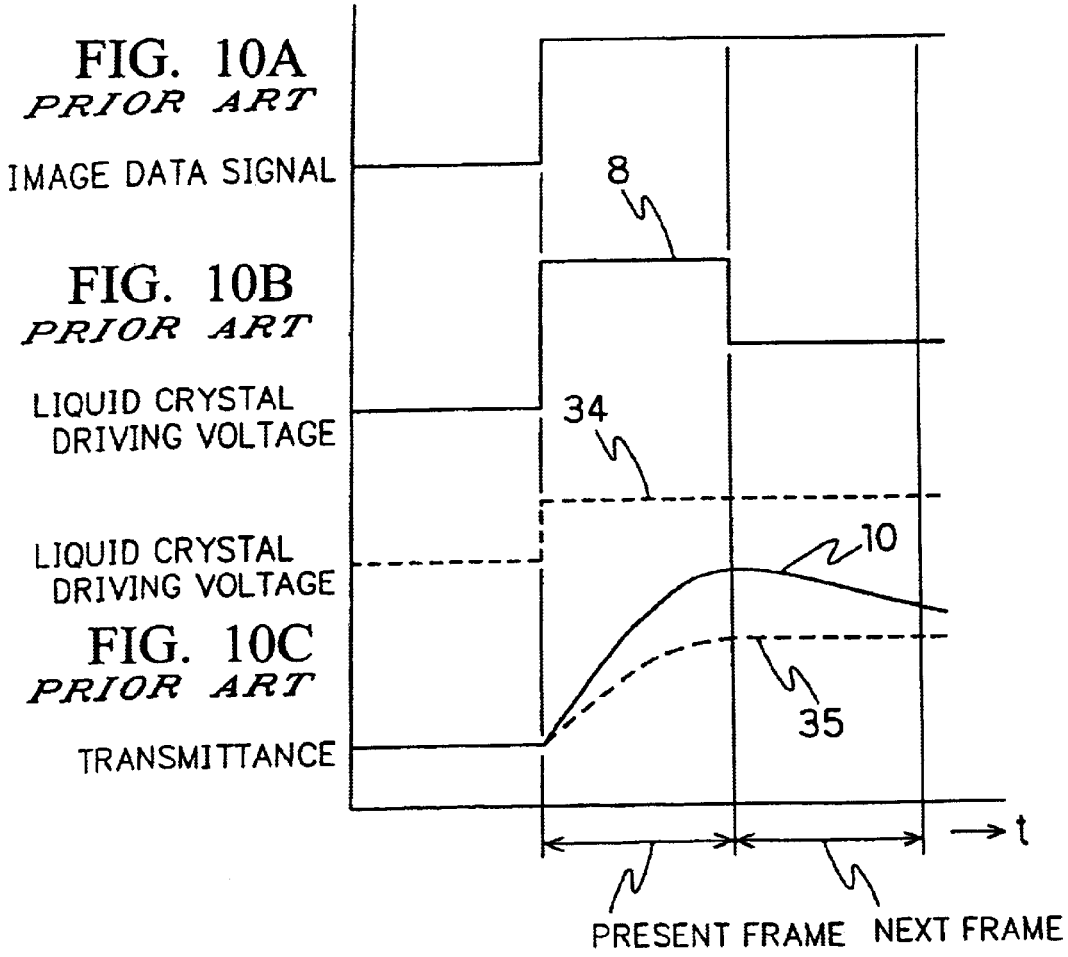
FIG. 10A PRIOR ART
FIG. 10B PRIOR ART
FIG. 10C PRIOR ART
FIG. 10 is graphs showing relations of image data signal against time, liquid crystal driving voltage against time, and transmittance against time in the conventional liquid crystal display apparatus.

Thereafter, a signal line driving circuit 22 shown in FIG. 6 converts the current corrected data signal into driving signal corresponding thereto and a liquid crystal display panel 20 is driven by the driving signal.

As can be seen from the above, in FIG. 1, when the original image data signal (i.e. current image data signal 1) thus inputted is higher than the previous corrected data signal 2, signal higher in value than the current image data signal 1 is generated as current corrected data signal 3 to quicken the response of liquid crystal. Therefore, as shown in FIG. 2(*b*) and similarly to the technique of Japanese Patent No. 2,616,652, the liquid crystal driving voltage 7 for the present frame becomes larger than that of former technique shown with "A" so that it becomes possible to realize the high speed response of the liquid crystal for the present frame as indicated by the transmittance 9 shown in FIG. 2(*c*). Furthermore, contrary to the technique of Japanese Patent No. 2,616,652, the current corrected data signal 3 which is enhanced in value by the correcting means 6 is stored into the storage means 4 and output as the previous corrected data signal 2. Accordingly, even if there is no change in current image data signal 1 among present and next field as shown in FIG. 2(*a*), the current image data signal 1 becomes smaller than the previous corrected data signal 2 which had been enhanced so that the liquid crystal driving voltage 7 for the next frame is set to be smaller than that of former technique shown with "A" in FIG. 2(*b*) by the correcting means 6 using the reference table 5.

Therefore, differing from the technique of Japanese Patent No. 2,616,652 in which the same driving voltage 8 as that of the former technique "A" is applied to the liquid crystal for next frame as shown in FIG. 2(*b*), it becomes possible to converge the transmittance of the liquid crystal more quickly onto the desired transmittance "B" as indicated by the transmittance 9 shown in FIG. 2(*c*).

As stated above, according to this embodiment, it is possible to accelerate the response speed of the display panel to suppress the occurrence of an after image without causing the deteriorated convergence of the transmittance so that a liquid crystal display apparatus capable of displaying good moving images is obtained.

In this embodiment, description has been given to a case in which the current corrected data signal 3 of one frame is stored into the storage means 4. Alternatively, a plurality of storage means 4 may be used to hold the current corrected data signals of a plurality of frames and a plurality of previous corrected data signals 2 may be inputted into the correcting means 6 as input signals, or the storage means 4 may be used to hold the current corrected data signals of a plurality of frames and the signals may be sequentially inputted into the correcting means 6 as previous corrected data signals. At 'k'th frame, for example, the current corrected data signals 3 of last and before the last frames, i.e. 'k-1'th and 'k-2'th frames, are output to the correcting means 6 as the previous corrected data signals 2 from the storage means 4. The correcting means 6 generates the current corrected data signals 3 of present 'k'th frame, from the current image data signal 1 and the previous corrected data signals 2 of 'k-1'th and 'k-2'th frames, using the reference table 5. It should be noted that in the case of above wherein the corrected data signals of two frames are stored in to the storage means 4, the reference table 5 should also e double-sized for said data signals of two frames. By constituting the reference table 5 such that image data signal compensating for a response delay peculiar to the display apparatus is generated as the current corrected data signal 3, it is possible to accelerate the response speed of the display panel and to obtain an afterimage reduction effect as in the case of this embodiment.

Further, according to this embodiment, by taking the two-frame-prior current corrected data signal into account in generating the current corrected data signal, it is possible for the liquid crystal panel to display good moving images. While the frame held by the storage means 4 is two in the above description, three or more frames are appropriately stored with considering the required moving image characteristics of the liquid crystal panel and the like.

Moreover, description has been given to a case of constituting the reference table to apply the image data signal compensating for a response delay peculiar to the display apparatus as the current corrected data signal in this embodiment. In addition, by further constituting the reference table 5 in considering the distribution of driving load, i.e. heavier remote from the driving circuit 22 and lighter in the vicinity of the driving circuit 22, to allow such a processing as to further increase the liquid crystal driving voltage applied to the remote portion of the liquid crystal panel away from the driving circuit, it is possible to compensate the distribution of driving load mainly caused by resistance, parastic capacitance and inductance of signal lines so that deterioration in displayed image is prevented.

EMBODIMENT 2

Figure 3:
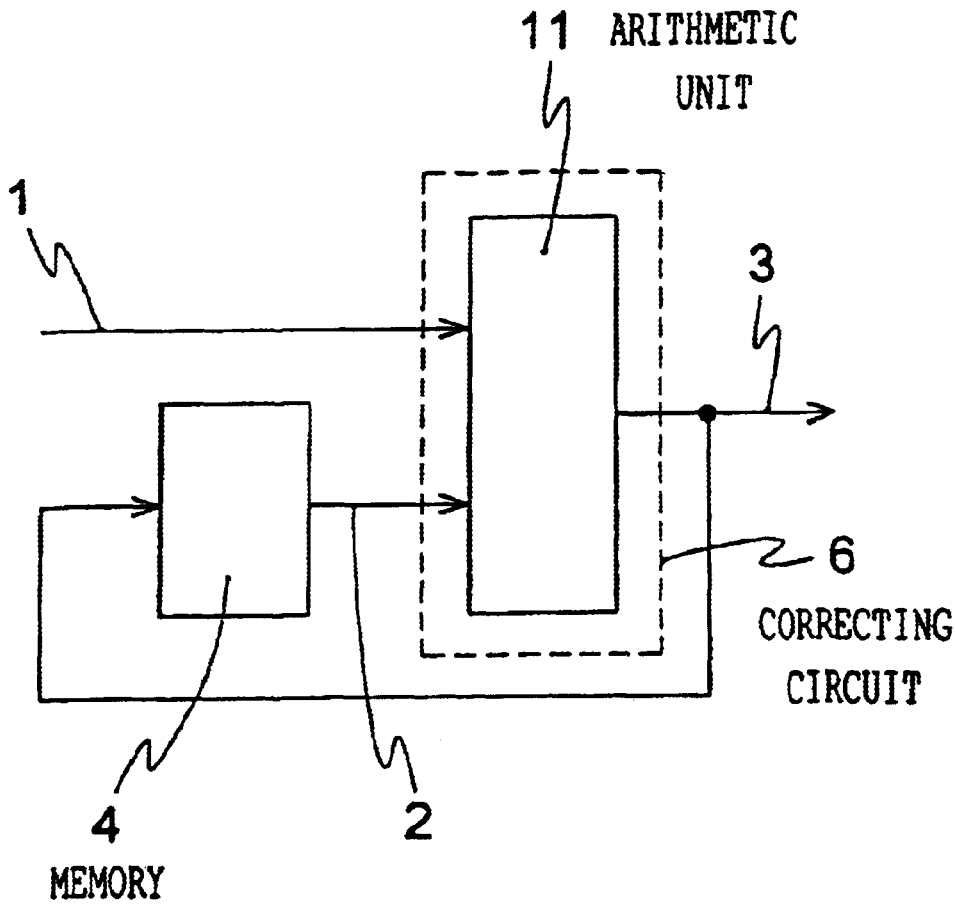
FIG. 3 is an explanatory view showing a correction circuit in a liquid crystal display apparatus of EMBODIMENT 2 of the present invention.

EMBODIMENT 2 of the present invention will be described hereinafter with reference to FIG. 3. FIG. 3 shows a correction circuit in EMBODIMENT 2. The correction circuit is normally formed in a control circuit 23 shown in FIG. 6. In FIG. 3, the same constituent elements as those in EMBODIMENT 1 are denoted by the same reference numerals, which will not be described herein in detail. Instead, the difference of EMBODIMENT 2 from EMBODIMENT 1 will be described.

In FIG. 3, reference numeral 11 denotes an arithmetic unit calculating a current corrected data signal 3. The correction circuit shown in FIG. 3 differs from that shown in FIG. 1 in that the arithmetic unit 11 is employed in FIG. 3 while the reference table 5 is employed in FIG. 1. The arithmetic unit 11 performs an operation to, for example, multiply each of a current image data signal 1 and a previous corrected data signal 2 inputted into the arithmetic unit 11 by a coefficient so as to compensate for a response delay particular to a display apparatus, and outputs the current corrected data signal 3.

By constituting the driving circuit as stated above, it is possible to accelerate the response speed of a display panel to suppress the occurrence of an afterimage, without causing the deteriorated convergence of transmittance so that a liquid crystal display apparatus capable of displaying good moving images is obtained as in the case of EMBODIMENT 1. Further, in this embodiment, since the arithmetic unit 11 replaces the reference table 5 in EMBODIMENT 1, an element for the reference table, for example, a memory becomes unnecessary and a circuit can be made small in size.

Furthermore, in this embodiment, the storage means 4 stores current corrected data signal of one-frame. Alternatively, a plurality of storage means 4 may be used to hold the current corrected data signals of a plurality of frames and a plurality of previous corrected data signals 2 may be inputted into the arithmetic unit 11 as input signals, or the storage means 4 may be used to hold the current corrected data signals of a plurality of frames and the signals may be sequentially inputted into the arithmetic unit 11 as previous corrected data signals. For example, if the storage means 4 hold the current corrected data signals of two frames, the current corrected data signals of 'k-2'th frame and 'k-1'th frame are inputted to the correcting means 6 as previous corrected data signals at the present 'k'th frame. The arithmetic unit 11 of the correcting means 6 computes and generates image data signal compensating for a response delay peculiar to the display apparatus based on the inputted previous corrected data signals and a current image data signal, and the correcting means 6 outputs the signal thus generated as the current corrected data signal 3 for the present 'k'th frame. By using two previous signals, i.e. previous corrected data signals for 'k-2'th frame and 'k-1'th frame, the correcting means 6 can outputs more suitable value for the current corrected data signal then the case wherein previous signal of only one frame is stored. Accordingly, it is possible to accelerate the response speed of the display panel and to obtain an afterimage reduction effect as in the case of this embodiment.

Further, according to this embodiment, by taking the two-frame-prior current corrected data signals into account in generating the current corrected data signal, it is possible for the liquid crystal panel to display good moving images. While the frame held by the storage means 4 is two in the above, three or more frames are appropriately stored with considering the required moving image characteristics of the liquid crystal display panel and the like.

Moreover, description has been given to a case of constituting the arithmetic unit 11 to calculate and output the image data signal compensating for a response delay peculiar to the display apparatus as the current corrected data signal in this embodiment. In addition, by further constituting the arithmetic unit 11 in considering the distribution of driving load, i.e. heavier remote from the driving circuit 22 and lighter in the vicinity of the driving circuit 22, to allow such a processing as to further increase the liquid crystal driving voltage applied to the remote portion of the liquid crystal panel away from the driving circuit, it is possible to compensate the distribution of driving load mainly caused by resistance, parastic capacitance and inductance of signal lines so that deterioration in displayed image is prevented.

EMBODIMENT 3

Figure 4:
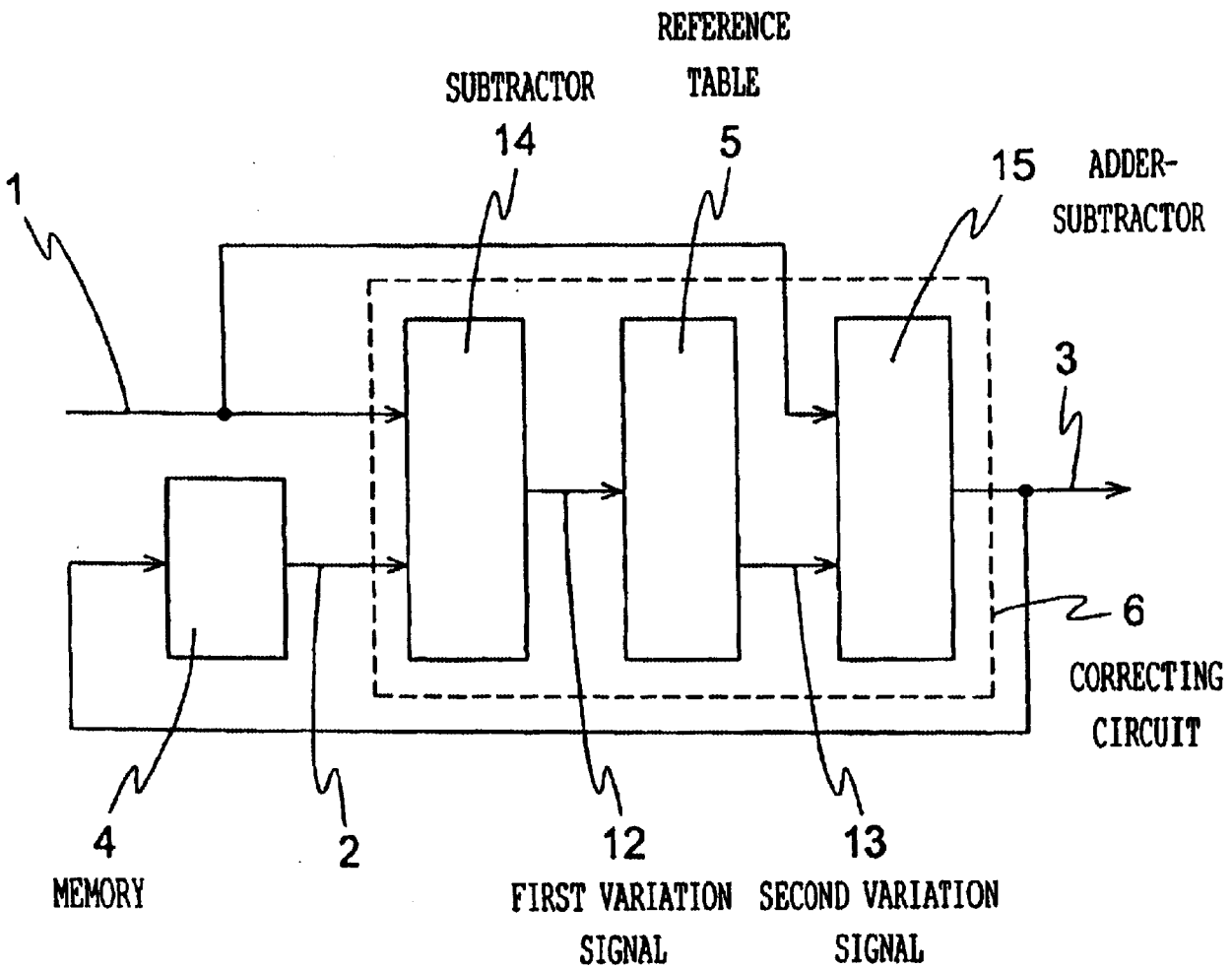
FIG. 4 is an explanatory view showing a correction circuit in a liquid crystal display apparatus of EMBODIMENT 3 of the present invention.

EMBODIMENT 3 of the present invention will be described hereinafter with reference to FIG. 4. FIG. 4 shows a correction circuit in EMBODIMENT 3. The correction circuit is normally formed in a control circuit 23 shown in FIG. 6. In FIG. 4, the same constituent elements as those in the embodiments 1 and 2 are denoted by the same reference numerals, which will not be described herein in detail. In FIG.4, reference numeral 12 denotes first variation signal which represents the difference between a current image data signal 1 and previous corrected data signal 2, reference numeral 13 denotes second variation signal which shall be added to the current image data signal 1 to generate the current corrected data signal 3, reference numeral 14 denotes a subtracter performing subtraction and reference numeral 15 denotes an adder-subtracter performing addition and subtraction.

In FIG. 4, first, current corrected signal 3 is fed back to and inputted into a storage means 4 and the current corrected data signal 3 of one frame are thereby held by the storage means 4. As a result, the current data signal 3 is delayed by one-frame period and outputted as a previous corrected data signal 2 from the storage means 4 to the subtracter 14. Based on the previous corrected data signal 2 outputted from the storage means and current image data signal 1 which is original input signal, the subtracter 14 outputs the first variation signal 12 which is the variation between the previous corrected data signal 2 and the current image data signals 1. By inputting the first variation 12 into a reference table 5, the reference table 5 generates and outputs a second variation signal 13. The second variation signal 13 shall be added to/subtracted from the current image data signal 1 to generate the current corrected data signal 3 compensating for a response delay peculiar to a display apparatus. Further, it is effective to constitute the reference table 5 used here to output the first variation signal 12 as the second variation signal 13 as it is if the fist variation signal 12 is zero and to output a value which absolute value is higher than the first variation signal 12 as the second variation signal 13 if the first variation signal 12 is not zero.

Consequently, when the second variation signal 13 outputted from the reference table 5 and the current image data signal 1 provided externally are inputted into the adding/subtracting means 15, the adding/subtracting means 15 adds or subtracts the second variation 13 to or from the current image data signal 1. Therefore, correcting means 6 as a whole, if the current image data signal 1 is equal to the previous corrected data signal 2, the current image data signal 1 is generated as the current corrected data signal 3, if the current image data signal 1 is higher than the previous corrected data signals 2, signal higher in value than the current image data signal 1 is generated as the current corrected data signal 3, and if the current image data signal 1 is lower than the previous corrected data signal 2, signal lower in value than the current image data signal 1 is generated as the current corrected data signal 3.

By constituting the driving circuit as stated above and shown in FIG. 4, when the current image data signal is originally inputted, corrected data signal compensating for a response delay peculiar to the display apparatus is generated as the current corrected data signal, thereby making it possible to accelerate the response speed of the display panel. Further, only the first variation signal 12 is inputted to the reference table 5 to generate the second variation signal 13, it is possible to make a circuit scale smaller than that in EMBODIMENT 1 and to thereby reduce cost.

Furthermore, if the second variation signal 13 is fed back to and inputted into the storage means 4 instead of feeding back and inputting the currently corrected data signal 3 and the storage means 4 also holds the current image data signal 1 for one frame, the same afterimage reduction effect can be obtained.

In this embodiment, description has been given to a case in which the current corrected data signal 3 of one frame is stored into the storage means 4. Alternatively, a plurality of storage means 4 may be used to hold the current corrected data signals of a plurality of frames and a plurality of previous corrected data signals 2 may be inputted into the subtracter 14 as input signals, or the storage means 4 may be used to hold the current corrected data signals of a plurality of frames and the signals may be sequentially inputted into the subtracter 14 as previous corrected data signals. For example, if the storage means 4 hold the current corrected data signals of two frames, the current corrected data signals of 'k-2'th frame and 'k-1'th frame are inputted to the subtracter 14 of the correcting means 6 as previous corrected data signals 2 at the present 'k'th frame. The subtracter 14 generates the first variation signals 12 from the current image date signal 1 and the previous corrected data signals 2, and the reference table 5 generates the second variation signal 13 from the first variation signals 12. It should be noted that in the case of above wherein the corrected data signals of two frames are stored into the storage means 4, the reference table 5 should also be double-sized for the first variation signals 12. By constituting the reference table 5 such that a signal to adjust the current image data signal compensating for a response delay peculiar to the display apparatus is generated as the second variation signal 13 and added to/subtracted from the current image data 1 by the adder/subtracter 15 to generate the current corrected data signal 3, it is possible to accelerate the response speed of the display panel and to obtain the afterimage reduction effect as in the case of this embodiment.

Further, as stated above, by taking the two-frame-prior current corrected data signals into account in generating the current corrected data signal, it is possible for the liquid crystal panel to display good moving images. While it is described above that the frames held by the storage means 4 is two frames, three or more frames are appropriately held in considering the required moving image characteristics of the liquid crystal panel and the like.

Moreover, description has been given to a case of constituting the reference table to use the image data signal compensating for a response delay peculiar to the display apparatus as the current corrected data signal in this embodiment as in the case of EMBODIMENT 1. In addition, by further constituting the reference table in considering the distribution of driving load, i.e. heavier remote from the driving circuit 22 and lighter in the vicinity of the driving circuit 22, to allow such a processing as to further increase the liquid crystal driving voltage applied to the remote portion of the liquid crystal panel away from the driving circuit, it is possible to compensate the distribution of driving load mainly caused by resistance, parastic capacitance and inductance of signal lines so that deterioration in displayed image is prevented.

EMBODIMENT 4

Figure 5:
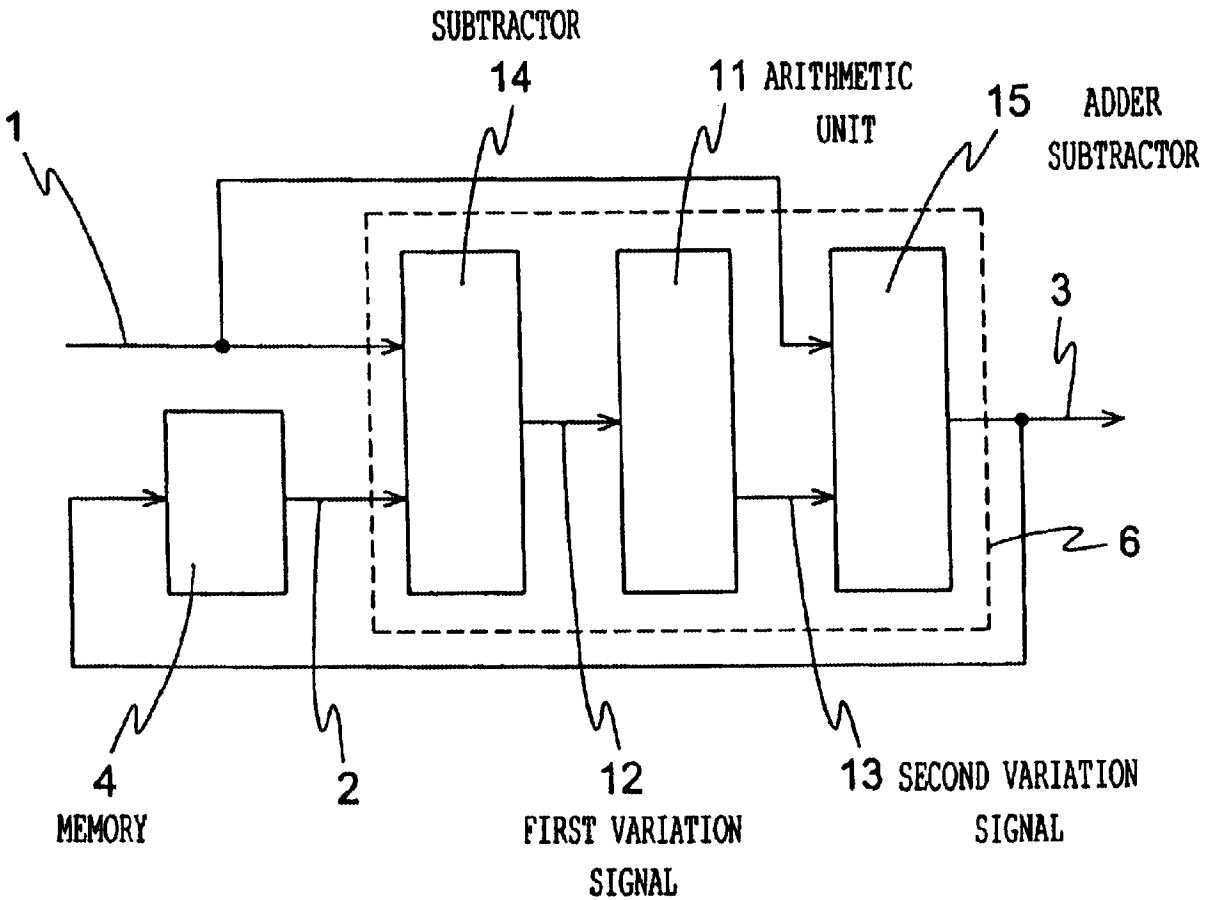
FIG. 5 is an explanatory view showing a correction circuit in a liquid crystal display apparatus of EMBODIMENT 4 of the present invention.

EMBODIMENT 4 of the present invention will be described hereinafter with reference to FIG. 5. FIG. 5 shows a correction circuit in EMBODIMENT 4. The correction circuit is normally formed in a control circuit 23 shown in FIG. 6. In FIG. 5, the same constituent elements as those in the embodiments 1, 2 and 3 shown in FIGS. 1, 3 and 4 are denoted by the same reference numerals, which description will not be given herein in detail. Instead, the difference of EMBODIMENT 4 from EMBODIMENT 3 shown in FIG. 4 will be described. The difference of the correction circuit shown in FIG. 5 from that shown in FIG. 4 is that the reference table 5 in FIG. 4 is replaced by a arithmetic unit 11 in FIG. 5.

With the constitution as stated above, when an original image data signal 1 is inputted, an image data signal compensating for a response delay in a display apparatus is generated as a current corrected data signal 3, thereby making it possible to accelerate the response speed of a display panel as in the case of EMBODIMENT 3. Besides, since not the reference table 5 consisting of, for example, a memory but the arithmetic unit 11 is used and such an operation as to multiply a signal by a coefficient is performed by the arithmetic unit 1, it is possible to make a circuit scale smaller than that in EMBODIMENT 3 and to thereby reduce cost. Further, since the arithmetic unit 11 operates only for the first variation signal 12, the circuit scale can be made smaller than that in EMBODIMENT 2.

Furthermore, as in the case of EMBODIMENT 3, if the second variation signal 13 is fed back to and inputted into the storage means 4 instead of feeding back and inputting the currently corrected data signal 3 and the storage means 4 also holds the current image data signal 1 for one frame, the same afterimage reduction effect can be obtained.

Furthermore, in this embodiment, description has been given to a case in which the current corrected data signal 3 of one frame is stored into the storage means 4. Alternatively, a plurality of storage means 4 may be used to hold the current corrected data signals of a plurality of frames and a plurality of previous corrected data signals 2 may be inputted into the subtracter 14 as input signals, or the storage means 4 may be used to hold the current corrected data signals of a plurality of frames and the signals may be sequentially inputted into the subtracter 14 as previous corrected data signals. For example, if the storage means 4 holds the current corrected data signals of two frames, the current corrected data signals of 'k-2'th frame and 'k-1'th frame are inputted to the subtracter 14 of the corrected means 6 as previous corrected data signals at the present 'k'th frame. The subtracter 14 subtracts the previous corrected data signals 2 from the current image data signal 1 to generate the first variation signals 12. The arithmetic unit 11 computes and generates image data signal to adjust the current image data signal compensating for a response delay peculiar to the display apparatus based on the first variation signals 12 and outputs as a second variation signal 13. The second variation signal 13 is added to/subtracted from the current image data signal 1 to generate the current corrected data signal 3 for present 'k'th frame. By using two previous signals, i.e. previous corrected data signals for 'k-2'th frame and 'k-1'th frame, the correcting means 6 can output more suitable value for the current corrected data signal than the case wherein previous signal of only one frame is stored. As described above, it is possible to accelerate the response speed of the display panel and to obtain an afterimage reduction effect as in the case of this embodiment.

Further, as stated above, by taking the two-frame-prior current corrected data signals into account in generating the current corrected data signal, it is possible for the liquid crystal pane to display good moving images. While the frames held by the storage means 4 is two frames in this embodiment, three or more frames are appropriately held in considering the required moving image characteristics of the liquid crystal display panel and the like.

Moreover, description has been given to a case of constituting the correcting means to calculate and output the image data signals compensating for a response delay peculiar to the display apparatus as the current corrected data signals in this embodiment as in the case of EMBODIMENT 1. In addition, by further constituting the reference table in considering the distribution of driving load, i.e. heavier remote from the driving circuit 22 and lighter in the vicinity of the driving circuit 22, to allow such a processing as to further increase the liquid crystal driving voltage applied to the remote portion of the liquid crystal panel away from the driving circuit, it is possible to compensate the distribution of driving load mainly caused by resistance, parastic capacitance and inductance of signal lines so that deterioration in displayed image is prevented.

Needless to say, in the present specification, "frame" is not limited to a frame representing a period in which all scanning lines are scanned by a non-interlace driving method but even if it means a field, for example, representing a period in which the scanning lines are alternately scanned once (subjected to interlace scanning) by an interlace driving method, the same advantages as the embodiments 1 to 4 can be obtained.

Further, in the embodiments 1 to 4 above, description has been given to a case where the correction means of the present invention is formed in the control circuit. The present invention is not limited thereto and the correction means may be formed between the control circuit and the liquid crystal panel such as in the signal line driving circuit.

Additionally, in the embodiments 1 to 4, description has been given to the display apparatus employing the liquid crystal. The present invention is not limited to such a display apparatus but may be applied to any types of display apparatuses displaying moving images such as a display apparatus employing an electroluminescence or a field sequential.

A display apparatus of the present invention comprises correcting means for generating a current corrected data signal using a current image data signal and a previous corrected data signal; storage means for holding the current corrected data signal of a predetermined frames, for delaying the current corrected data signal by a maximum of the period of the predetermined frames, and for outputting the current corrected data signal thus delayed as the previous corrected data signal; and display means driven by a driving signal corresponding to the current corrected data signal. It is, therefore, possible to correct the current image data signal and to generate the corrected current image data signal as the current corrected data signal.

A display apparatus of the present invention is characterized in that the correcting means includes means for generating the current image data signal as the current corrected data signal if the current image data signal is equal to the previous corrected data signal, for generating a signal higher in value than the current image data signal as the current corrected data signal if the current image data signal is higher than the previous corrected data signal, and for generating a signal lower in value than the current image data signal as the current corrected data signal if the current image data signal is lower than the previous corrected data signal. It is, therefore, possible to suppress the occurrence of an afterimage when displaying moving images.

A display apparatus of the present invention is characterized in that the period of said predetermined frames is a one-frame period. Thus, a circuit configuration which is small in size makes it possible to suppress the occurrence of an afterimage when displaying moving images.

A display apparatus of the present invention is characterized in that the correcting means includes a table or a arithmetic unit generating the current corrected data signal compensating for a response delay particular to the display apparatus. It is, therefore, possible to further suppress the occurrence of an afterimage when displaying moving images.

A display apparatus of the present invention is characterized in that the correcting means includes a subtracter calculating a first variation signal, the first variation signal being a variation between the current image data signal and the previous corrected data signal; a table or a calculating element generating a second variation signal from the first variation signal, the second variation signal being a variation for the current corrected data signal from current image data signal to compensate for the response delay peculiar to the display apparatus; and an adding/subtracting means performing addition and/or subtraction using the current image data signal and the second variation signal, and calculating the current corrected data signal. Thus, a circuit configuration which is small in size makes it possible to further suppress the occurrence of an afterimage when displaying moving images.

A method for driving the display apparatus of the present invention comprises a first step of generating a current corrected data signal using a current image data signal and a previous corrected data signal; a second step of holding the current corrected data signal of a predetermined frames, delaying the current corrected data signal by a maximum of the period of the predetermined frames, and outputting the current corrected data signal thus delayed as the previous corrected data signal; and a third step of driving display means by a driving signal corresponding to the current corrected data signal. It is, therefore, possible to drive the display apparatus by correcting the current image data signal and generating the corrected current image data signal as the current corrected data signal.

A method for driving the display apparatus of the present invention is characterized in that the first step includes a step of generating the current image data signal as the current corrected data signal if the current image data signal is equal to the previous corrected data signal, generating a signal higher in value than the current image data signal as the current corrected data signal if the current image data signal is higher than the previous corrected data signal, and generating a signal lower in value than the current image data signal as the current corrected data signal if the current image data signal is lower than the previous corrected data signal. It is, therefore, possible to drive the display apparatus so that the occurrence of an afterimage can be suppressed when displaying moving images.

A method for driving the display apparatus of the present invention is characterized in that the period of the predetermined frames is a one-frame period. Thus, a circuit configuration which is small in size makes it possible to drive the display apparatus so that the occurrence of an afterimage can be suppressed when displaying moving images.

A method for driving the display apparatus is characterized in that the first step includes a step of generating the current corrected data signal compensating for a response delay particular to the display apparatus. It is, therefore, possible to drive the display apparatus so that the occurrence of an afterimage can be further suppressed when displaying moving images.

A method for driving the display apparatus of the present invention is characterized in that the first step includes a step of calculating a first variation signal, the first variation signal being a variation between the current image data signal and the previous corrected data signal; a step of calculating a second variation signal from the first variation signal, the second variation signal being a variation for the current corrected data signal from the present image data signal to compensate for the response delay particular to the display apparatus; and a step of performing addition and/or subtraction using the current image data signal and the second variation signal, and calculating the current corrected data signal. Thus, a circuit configuration which is small in size makes it possible to drive the display apparatus so that the occurrence of an afterimage can be further suppressed when displaying moving images.

The forgoing is considered as illustrative only of the principles of the invention. Further, because numerous modifications and changes will readily occur to those skilled in the art, it is not desired to limit the invention to the exact construction and operation shown and described, and accordingly all suitable modifications and equivalents may be resorted to falling within the scope of the invention as defined by the claims which follow.

What is claimed is:

1. A display apparatus comprising:

a correcting means for producing a current corrected data signal by using a current image data signal and a previous corrected data signal;

a storage means for storing said current corrected data signal within a predetermined frame period and outputting said current corrected data signal as the previous corrected data signal in such a manner as to be delayed at most said predetermined frame period; and a display means driven by a driving signal corresponding to said current corrected data signal, wherein said correcting means includes means for producing a current image data signal as the current corrected data signal when the current image data signal is equal to the previous corrected data signal, producing a value greater than said current image data signal as the current corrected data signal when said current image data signal is greater than the previous corrected data signal, and producing a value smaller than said current image data signal as the current corrected data signal when said current image data signal is smaller than the previous corrected data signal so that producing a change in the current corrected data signal is greater than a change of the current image data signal for a first predetermined frame period, smaller than the change of current image data signal for a second predetermined frame period and converging to the change of current image data signal for a third predetermined frame period.

2. The display apparatus of claim 1, wherein the predetermined frame period is 1 frame period.

3. The display apparatus of claim 1, wherein the correcting means includes a means for producing the current corrected data signal to compensate a delayed time for responding which is peculiar to the display apparatus, and wherein said means for producing is any one of an arithmetic unit and a table.

4. The display apparatus of claim 1, wherein said correcting means comprises:

a subtracting means for calculating a first value changing from the previous corrected data signal to the current image data signal;

an arithmetic unit means for producing a changed value as a second value from said first value to compensate a delayed time for responding which is peculiar to the display apparatus; and an adding/subtracting means for calculating the current corrected data signal by adding and/or subtracting the current image data signal and the second value.

5. A method for driving a display apparatus, said method comprising steps of:

(i) producing a current corrected data signal from a current image data signal and a previous corrected data signal;

(ii) retaining said current corrected data signal for a predetermined frame period, and outputting said currently corrected data signal serving as a previous corrected data signal after a prescribed delayed time at most said predetermined frame period; and (iii) driving a displaying means by a driving signal corresponding to said current corrected data signal, wherein in the step (i), said current image data signal is produced as the current corrected data signal when said current image data signal is equal to said previous corrected data signal, a value greater than said current image data signal is produced as the current corrected data signal when said current image data signal is greater than said previous corrected data signal, and a value smaller than said current image data signal is produced as the current corrected data signal when said current image data signal is smaller than said previous corrected data signal so that producing a change in the current corrected data signal is greater than a change of the current image data signal for a first predetermined frame period, smaller than the change of current image data signal for a second predetermined frame period and converging to the change of current image data signal for a third predetermined frame period.

6. The method of claim 5, wherein the predetermined frame period is a single frame period.

7. The method of claim 5, wherein the step (i) includes a step of generating a current corrected data signal where a delay of a response peculiar to a liquid crystal display is compensated.

8. The method of claim 5, further comprising the steps of:

calculating a first value changing from the previous corrected data signal to the current image data signal;

generating a second value from said first value, said second value serving as a changing value of the current corrected data signal from the current image data signal for compensating a delay of a response peculiar to a liquid crystal display; and calculating a current corrected data signal by adding said second value to said current image data signal or subtracting said second value from said current image data signal.

9. A display apparatus comprising:

a correcting circuit configured to produce a current corrected data signal by using a current image data signal and a previous corrected data signal;

a memory configured to store said current corrected data signal within a predetermined frame period, and to output said current corrected data signal as the previous corrected data signal in such a manner as to be delayed at most said predetermined frame period; and a display configured to be driven by a driving signal corresponding to said current corrected data signal, wherein said correcting circuit produces a current image data signal as the current corrected data signal when the current image data signal is equal to the previous corrected data signal, produces a value greater than said current image data signal as the current corrected data signal when said current image data signal is greater than the previous corrected data signal, and produces a value smaller than said current image data signal as the current corrected data signal when said current image data signal is smaller than the previous corrected data signal so that producing a change in the current corrected data signal is greater than a change of the current image data signal for a first predetermined frame period, smaller than the change of current image data signal for a second predetermined frame period and converging to the change of current image data signal for a third predetermined frame period.

10. The display apparatus of claim 9, wherein the predetermined frame period is 1 frame period.

11. The display apparatus of claim 9, wherein the correcting circuit includes one of an arithmetic unit and a table to produce a current corrected data signal to compensate a delayed time for responding which is peculiar to the display apparatus.

12. The display apparatus of claim 9, wherein said correcting circuit comprises:

a subtracting circuit configured to calculating a first value changing from the previous corrected data signal to the current image data signal;

an arithmetic unit configured to producing a changed value as a second value from said first value to compensate a delayed time for responding which is peculiar to the display apparatus; and an adding/subtracting circuit configured to calculate the current corrected data signal by adding and/or subtracting the current image data signal and the second value.

* * * * *